US006680290B1

(12) United States Patent
Lenoir

(10) Patent No.: US 6,680,290 B1
(45) Date of Patent: Jan. 20, 2004

(54) CLEAR SOFTENING FORMULATIONS INCLUDING ALKOXYLATED ADDITIVES

(75) Inventor: Pierre Marie Lenoir, Richterswil (CH)

(73) Assignee: Dow Europe S.A., Horgen (CH)

( * ) Notice: Subject to any disclaimer, the term of this patent is extended or adjusted under 35 U.S.C. 154(b) by 43 days.

(21) Appl. No.: 10/009,194

(22) PCT Filed: Jun. 29, 2000

(86) PCT No.: PCT/US00/17913

§ 371 (c)(1),
(2), (4) Date: Dec. 4, 2001

(87) PCT Pub. No.: WO01/02522

PCT Pub. Date: Jan. 11, 2001

Related U.S. Application Data

(60) Provisional application No. 60/142,210, filed on Jul. 2, 1999.

(51) Int. Cl.[7] ..... C11D 1/722
(52) U.S. Cl. ..... 510/527; 510/506
(58) Field of Search ..... 510/515, 506, 510/527

(56) References Cited

U.S. PATENT DOCUMENTS

| | | | | |
|---|---|---|---|---|
| 5,501,810 A | * | 3/1996 | Eugster et al. | 252/89.1 |
| 5,939,377 A | * | 8/1999 | Ewbank et al. | 510/475 |
| 6,211,139 B1 | * | 4/2001 | Keys et al. | 510/504 |
| 6,294,513 B1 | * | 9/2001 | Jensen et al. | 510/444 |

* cited by examiner

*Primary Examiner*—John Hardee

(57) ABSTRACT

The present invention relates to softening formulations, and especially fabric softening formulations, which remain clear at relatively low temperatures and at relatively low concentrations of the active fabric softening ingredients. The formulations comprise an active fabric softening composition and an additive corresponding to the formula: $R_1$—Q—$(AO)_n$—$R_3$, where $R_1$ is $C_{1-18}$ alkyl; Q is O, C(O)0, or $NR_1$; A is $CH_2CHR_2$; $R_2$ and $R_3$ are independently at each occurrence H or $C_{1-4}$alkyl; and n is 2 to 13; with the proviso that at least one $R_2$ is H and at least one $R_2$ is not H. The formulations preferably also contain water and a solvent which can be aliphatic alcohols having 1 to 6 carbon atoms, aryl alkyl alcohols; aliphatic polyalcohols and their alkoxylates, aliphatic ethers, aliphatic esters, or alkylene carbonates and mixtures thereof.

29 Claims, No Drawings

CLEAR SOFTENING FORMULATIONS INCLUDING ALKOXYLATED ADDITIVES

This application benefit of U.S. Provisional Appl. 60/142,210, filed Jul. 2, 1999.

The present invention relates to softening formulations, and especially fabric softening formulations, which remain clear at relatively low temperatures and at relatively low concentrations of the active fabric softening ingredient. More particularly the invention relates to a formulation comprising an active fabric softening ingredient, water, and an alkoxylated species having a mono function H, such as alcohols, fatty acids and amines. The formulations may optionally contain solvents, and other additives generally used in fabric softening or detergent compositions.

Fabric softening formulations have long been used to render washed clothing or other articles, softer to the touch. It is believed, however, that many consumers avoid the use of fabric softeners due in part to the typical fabric softener's cloudy appearance. Some consumers perceive that the cloudiness will leave a residue on the laundered articles, dulling the colors, and perhaps irritating skin which may come into contact with it. Thus, there is a need for fabric softening compositions having a water-like clear appearance.

Many attempts at clear fabric softening formulations have been reported in the literature. For example, U.S. Pat. No. 5,490,944, teaches a clear fabric softening composition containing an amido imidazolinium compound. This reference also teaches that the inclusion of solvents may aid in the formulation of clear softeners. U.S. Pat. Nos. 5,525,245 and 5,656,585 teach clear fabric softening formulations having diester and/or diamido ammonium active ingredients together with relatively high levels of organic solvents. WO 97/03169 teaches clear formulations having relatively high concentrations of fabric softener with relatively high amounts of specific principle solvents. WO 98/23808 teaches clear fabric softener compositions comprising an imidazolinium salt, a quatemary ammonium salt, a solvent, and a polyoxyethylene alkylether, having from 9 to 60 EO units. WO 99/09122 teaches using a principal solvent as taught in WO 97/03169 together with a nonionic preferably ethoxylated surfactant.

It is desired to improve upon these reported formulations by allowing lower concentrations of active fabric softening ingredients if desired, by allowing less concentration of the odorous solvents, by allowing the use of more readily available and hence economical additives, and by allowing the formulations to be more stable and to remain clear at lower temperatures.

The formulations of the present invention improve on some or all of these objects.

The Applicants have found that many of these objectives can be facilitated by the use of an additive which corresponds to the formula: $R_1—Q—(AO)_n—R_3$, where $R_1$ is $C_{1-18}$ alkyl, cylcdoalkyl or aryl; Q is O, C(O)O, or NR,; A is $CH_2CHR_2$; $R_2$ and $R_3$ are independently at each occurrence H or $C_{1-4}$ alkyl; and n is 2 to 13; with the proviso that in at least one AO group $R_2$ is H and in at least one AO group $R_2$ is not H.

These additives can be combined with known detergent or fabric softening active ingredients as well as lower aliphatic solvents, water, and other ingredients typically used in fabric softening formulations.

The formulations of the present invention comprise:

(A) an active fabric softening composition;

(B) an additive corresponding to the formula:

$$R_1—Q—(AO)_n—R_3,$$

where $R_1$ is $C_{1-18}$ alkyl, cylcloalkyl or aryl; Q is O, C(O)O, or $NR_1$; A is $CH_2CHR_2$; $R_2$ and $R_3$ are independently at each occurrence H or $C_{1-4}$ alkyl; and n is 2 to 13; with the proviso that in at least one AO group $R_2$ is H and in at least one AO group $R_2$ is not H; and preferably (C) water.

The formulations may also include a lower aliphatic solvent, and other additives typically found in detergent or fabric softening compositions.

The active fabric softening ingredient used in the formulations of the ingredient can be selected from any of those known in the art, such as those described in the review article "Rinse-Added Fabric Softener Technology at the Close of the Twentieth Century", Matthew I. Levinson, *Journal of Surfactants and Detergents*, Vol 2, No.2, pages 223–235 (April, 1999). Typically the active ingredient will be a quatemary ammonium compound, especially an ester quatermary ammonium compound ("ester quats"), diamido amines and diamido ammonium compounds, and amido imidazolinium compounds.

Non ester quaternary ammonium compounds are characterized by having a quatemized ammonium where at least one of the branches attached to the nitrogen contains a long ($C_8$—$C_{22}$) alkyl chain. Preferably there are two such long alkyl chains. Suitable non ester quaternary ammonium compounds are described for example in WO 99/09122.

In general the esterquat class of compounds is characterized by having a central nitrogen being joined to four organic groups, at least one of which contains an organic acid moiety, that is, a C(O)OR group, where R is the remaining portion of the fatty acid used to make the ester. It is preferred that two of the organic groups joined to the nitrogen contain esters. It is also preferred that 50 to 100 percent of the ammonium compounds present be quatemized. Suitable esterquats are described for example in WO 99/09122, U.S. Pat. Nos. 5,490,944, 5,656,585, WO 98/45394, and WO 97/03169. Suitable but non limiting examples of diesterquats are: methyl bis(oleoyl-oxy-ethyl)-(2-hydroxyethyl) ammonium methyl sulfate (TEA diesterquat); N,N-di(oleoyl-oxy-ethyl)-N,N-dimethyl ammonium chloride (MDEA diesterquat); and 1,2-dioleoyloxy-3-N,N,N-trimethylammoniopropane chloride (DMAPD diesterquat).

Suitable, but non limiting, examples of diamido ammonium compounds are described, in U.S. Pat. Nos. 5,525,245, 5,656,585, and WO 99/09122. Some specific examples include diamido (oleic type) alkoxylated or not (EO, PO, and or BO) amines and their quatemary ammonium salts (DETA based) of the formula:

$$[R^4—(CO)—NR^6—(CH_2CH_2)—N(R^5)(R^8)—(CH_2CH_2)—NR^6—(CO)—R^4]^+, A^-$$

wherein $R^4$ together with (CO) is an oleoyl group; $R^5$ is H, $C_1$–$C_4$ alkyl or $(CH_2—CR^7HO)_t$—H, with t being from 1 to 7; $R^6$ is H, or $CH_2—CR^7HOH$; and $R^7$ is H or $C_1$–$C_4$ alkyl; $R^8$ is not present or $C_xH_{2x+1}$, where x is 0 to 4 and $A^-$ is an inorganic or organic acid anion (such as methyl sulfate, or a chloride anion) or not present when $R^8$ is not present. It will be readily understood by those in the art that if $R^8$ and $A^-$ are not present then, the "+" designation in the formula will also disappear.

Suitable amido imidazolinium compounds are described, for example in WO 99/09122, WO 98/23808, and U.S. Pat. No. 5,490,944.

Other materials which may be used as the fabric softening active ingredient in the formulations of this invention include the amido esterquats of U.S. Pat. No. 5,580,481 and their respective amido esteramines.

It is preferred that whenever a fatty acid or derivative (that is, a material containing a moiety corresponding to the formula RC(O)O—) is used to prepare the active fabric softening ingredient, such as in the quaternary ester compounds, then the fatty acid has an iodine value of between 20 and 140, especially for fatty acids having a predominant chain length in the range of $C_{16}$–$C_{18}$. For fatty acids having a chain length in the range of $C_{12-14}$, iodine values of 0 to 100 are preferred. Preferred fatty acids are described in WO 97/03169, see for example, pages 18 to 21. As is taught in the art, there may be situations where a preponderance of either the cis or the trans isomer of a particular unsaturated fatty acid may be preferred. It should be understood that mixtures of fatty acids may also be advantageously used.

The fatty acid used is typically derived from a triglyceride source. Suitable and non limiting examples of triglyceride sources are those derived from tallow, partially hardened tallow, lard, partially hardened lard, vegetable oils and/or partially hydrogenated vegetable oils, such as, canola oil, safflower oil, peanut oil, sunflower oil, corn oil, sunbean oil, tall oil, rice bran oil, coconut oil, palm oil, cotton seed oil, olive oil, cod liver oil, and mixtures of these oils.

One of the observed advantages of the formulations of the present invention is that in general they tend to remain clear at relatively lower concentrations of the fabric softening active ingredient. Thus, the fabric softening active ingredient may be present in the formulation in an amount of from 1 to 85 percent based on the weight of the total formulation. Preferably it is added in a range of from 5 to 70 and more preferably from 10 to 65.

The additive to be used in the formulations of the present invention correspond to the formula:

$$R_1—Q—(AO)_n—R_3$$

where $R_1$ is $C_{1-18}$ alkyl, cycloalkyl or aryl; Q is preferably O, but can also be C(O)0, or $NR_1$; A is $CH_2CHR_2$; $R_2$ and $R_3$ are independently at each occurrence H or $C_{1-4}$ alkyl; and n is 2 to 13; with the proviso that at least one $R_2$ is H and at least one $R_2$ is not H. Thus the alkoxylated additives to be used in the formulations of the present invention will contain at least one mole of ethylene oxide ("EO") and one mole of a higher oxide such as propylene oxide ("PO") or butylene oxide ("BO"). It should be understood that although this application will mention specific moles of the various oxides for convenience, in practice, a pure additive in which each molecule has the given number of moles of alkyl oxides will not be used. Rather the alkoxylated additive used will be a distribution of different alkoxylated additive molecules whose average number is represented by the formula.

The additives of the present invention tend to be hydrophobic and tend to have a cloud point around room temperature or less. These additives tend to be liquid at room temperature, making them ideal for the manufacturing and handling of fabric softener formulations.

It is preferred that $R_1$ is an alkyl group and the alkyl group may be branched or linear, saturated or unsaturated. It is preferred that $R_1$ contain from 2 to 17 carbon atoms, and more preferably from 3 to 15.

It is preferred that $R_3$ be H. The preferred AO units are those derived from EO, PO, and BO. The alkylene oxide portion of the additive may be added by random or block addition or a mixture thereof. Due to the relative reactivities of EO versus higher oxides, if the addition is random, the EO will tend to be added first. It is also possible to add the oxide units in a mixed block/random fashion, for example, by adding a few moles of PO or BO first and then by adding a mixed feed of EO with PO or BO. Similarly, it is possible to add the mixed feed first and then cap the additive with higher AO units by the addition of pure higher alkylene oxide.

One preferred class of additives has 1 to 8 moles of EO followed by 1 to 5 moles of BO and/or PO. Another preferred class has 1 to 5 moles of PO and/or BO followed by 1 to 3 moles of EO. Still another preferred class has 1 to 3 moles of PO and/or BO followed by a random or block addition of 1 to 8 moles of EO with an additional 1 to 3 moles of PO and/or BO. Still another preferred class of additives results from the completely random addition of 1 to 8 moles of EO with 1 to 5 moles of BO and/or PO. Yet another class of additives has a block of 1 to 8 EO units followed by the random addition of 2 to 7 moles of EO with PO and/or BO.

The additives can be added in an amount of from 1 to 60 percent by weight based on the total formulation. Preferably it is added in an amount of from 3 to 50, more preferably from 5 to 35.

The additives of the present invention can be prepared by alkoxylating a starting material having the formula $R_1$—Q—H where $R_1$ and Q are as defined before. Any method of alkoxylation may be used. The alkoxylation reaction may be carried out in the presence of an alkaline catalyst, such as sodium, potassium, calcium, barium and strontium hydroxide, in an amount of from 0.01 to 5, preferably 0.1 to 0.5, percent by weight based on the total weight of the mixture at the completion of the reaction. Temperature and pressures are not critical, but conveniently the alkoxylation reaction is carried out at an elevated temperature, preferably at a temperature from 50° C. to 200° C., more preferably from 80° C. to 140° C. and a pressure of from 1 to 80 bars. The alkaline catalysts suitable for use in this reaction are well known to a person skilled in the art. After completion of the reaction, that is, for example, when the pressure does not change anymore, the catalyst is removed by a suitable method, such as by filtration over an absorbing clay, for example, magnesium silicate, or neutralized with an inorganic acid such as, for example, hydrochloric acid, or an organic acid such as, for example, acetic acid.

In addition to the facilitation of clear fabric softening formulations, the additives of the present invention offer many other advantages. As these additives are not traditional solvents, they avoid many of the problems associated with the traditional solvents. Thus, by using the additives of the present invention instead of some or all of the solvents specified in the prior art, odor and flammability issues are reduced. Furthermore, the additives of the present invention are surfactants and thus may offer additional cleaning properties. It is also believed that the formulations including the additives may facilitate or even eliminate the need for ironing the clothes after the wash.

The formulation of the present invention can also include up to 25 percent by weight of a solvent selected from aliphatic alcohols, aryl alkyl alcohols, aliphatic polyalcohols and their alkoxylates, aliphatic ethers, alkylene carbonates, and aliphatic esters. These solvents can help reduce the viscosity of the formulations and help clarity, especially at lower temperatures. In general, the lower the concentration of these solvents present in the formulation the better, so long as the formulation remains clear. Typically these solvents are present in an amount from 0.1 to 15 percent by weight of the formulation, but can comprise less than 10 or even less than 6 percent of the formulation.

Suitable solvents are generally known in the art, and are listed for example in U.S. Pat. No. 5,525,245 or WO 99/09122. Other solvents which may be used include the "principal solvents" (for example, those solvents with a Clog P value of from 0.15 to 1.0) listed in WO 97/03169 and WO 99/09122. Preferred solvents include propanol, isopropyl alcohol, ethanol, butanol, ethylene glycol, 1,3-propane diol, propylene glycol, propylene carbonate, glycol ethers such as DOWANOL™ (trademark of The Dow Chemical Company) P and E series including dipropylene glycolpropyl ether (DPnP) and dipropylene glycolbutyl ether (DPnB), diethylene glycol butyl ether (DB), 1,4-cyclohexandimethanol and glycerol.

Other ingredients typically used in fabric softeners and detergents may also be used in the formulations of the present invention. These are known in the art (see for example WO 99/09122, U.S. Pat. No. 5,656,585, WO-97/31889, WO 98/35002, WO-A-95/19951, WO-A-93/25648, WO-A-93/23510, WO-A-96/21715, WO-A-96/09436, WO-A-94/29521, GB 2 197 66 A, EP 0 413 249 A1, WO 98/41604, WO 97/03169, WO 98/18890, WO 96/33800 and EP-A-0580245) and include things such as brighteners; dispersibility aids such as cationic surfactants (for example, monoalkyl quatemary ammonium compounds), nonionic surfactants (such as $C_4$–$C_{20}$ fatty alcohols or fatty acids ethoxylated with up to 15 moles of EO), and amine oxides; stabilizers; soil-release agents; scum dispersant; perfumes; chelating agents; enzymes; colorants; preservatives; anti-shrinking agents; viscosity modifiers such as polyethylene glycols and polypropylene glycols; bactericides and germicides; anti-corrosion agents; pH adjusters (for example, HCl, or organic acids such as acetic acid, lactic, fumaric acid, or maleic acid); fatty acids, fatty alcohols, fatty esters, fatty amines, and amidoamines.

Finally, the formulations of the present invention may advantageously contain water or be anhydrous. If water is present, it may comprise more than 10 percent of the formulation, more preferably more than 20 percent, and most preferably more than 30 percent by weight of the formulation. It should be understood that the formulations of the present invention are typically microemulsions and/or liquid crystals and as such will turn turbid at very high concentrations of water such as when diluted in the rinse cycle.

The formulations of the present invention can be made in several ways, as should be readily understood in the art. For example, the individual components (that is, fabric softening active ingredient, the additive, water and any optional ingredients) can be simply blended together (at elevated temperatures if required) in any order. In the case where the fabric softener active ingredient is based on the fatty acid, however, it may be advantageous to add at least a portion of the additive of the present invention at any point after the chemical reaction of the fatty acid (esterification and/or amidation). For example, in the synthesis of an ester quat, the additive could be added after the esterification and either before, during or after the quatemization step, enabling the reduction or even the elimination of the traditional solvents used in such process.

EXAMPLES

The following examples (and comparative examples) are included for illustration purposes and should not be interpreted as limiting the scope of the invention or the claims. The Examples were prepared by first melting the active fabric softener and then mixing in the additive and the solvent. Water was then added to reach the final reported concentrations. The mixtures were then visually inspected to see if it was clear and had an appropriate viscosity. Those formulations which were clear and had an appropriate viscosity are labelled "yes" in the table and those which were turbid and/or were a gel are labelled "no". The components of each Example as well as the results are presented in Table I. The additive was added in an amount to give 20 percent by weight in the final formulation unless otherwise indicated. In the table, all percentages are by weight (with the balance being water) and the following items have the following meanings:

ACROPOL 35 is a trademark from BASF and designates $C_{13}$–$C_{15}$ oxo-alcohol. Fabric softener 1 ("FS 1") is a triethanolamine esterquat based on oleic acid, and fabric softener 2 ("FS 2") is a methyidiethanolamine esterquat based on oleic acid. IPA is isopropyl alcohol, PG is propylene glycol, and DB is diethylene glycol butyl ether.

TABLE I

| Additive | FS 1 | FS 2 | IPA | PG | Ethanol | DB | Remarks |
|---|---|---|---|---|---|---|---|
| $C_8$ + 2BO + 4EO | 20 | | 5 | | | | No |
| $C_8$ + 4EO + 1BO | 20 | | 5 | | | | Yes |
| $C_8$ + 4EO + 2BO | 20 | | 5 | | | | Yes |
| $C_8$ + 0.5BO + 3EO | 20 | | 5 | | | | No |
| $C_{10/14}$ lin. + 10EO + 2BO | 20 | | 5 | | | | No |
| $C_{9-11}$ 2.5EO | 20 | | 5 | | | | No |
| $C_{12-15}$ 5EO | 20 | | 5 | | | | No |
| Acropol 35 + 6.5EO | 20 | | 5 | | | | No |
| 2-Ethylhexanol + 2.5EO + 1PO | 20 | | 5 | | | | Yes |
| $C_8$ + 2PO + 5EO | 20 | | 5 | | | | No |
| Acropol 35 + 5PO + 1.5EO | 20 | | 5 | | | | Yes |
| Acropol 35 + 5PO + 3.5EO | 20 | | 5 | | | | No |
| $C_8C_{10}$ lin. 1.6EO/1.6PO mix | 20 | | 5 | | | | Yes |
| PO-EO block copolymer | 20 | | 5 | | | | Yes |
| $C_4$ 2EO/2PO | 20 | | 5 | | | | Yes |
| $C_8$ EO/PO MW300 | 20 | | 5 | | | | No |
| DPnB about 50/50 EO/PO mw | 20 | | 5 | | | | No |
| $C_4$ + 2PO | 20 | | 5 | | | | Yes |
| $C_{12}$ + 7.7PO | 20 | | 5 | | | | Yes |
| $C_8$ + 4EO + 1BO | 20 | | | 5 | | | Yes |
| $C_8$ + 4EO + 1BO at 12% | 12 | | 3 | | | | Yes |

TABLE I-continued

| Additive | FS 1 | FS 2 | IPA | PG | Ethanol | DB | Remarks |
|---|---|---|---|---|---|---|---|
| $C_8$ + 4EO + 1BO | 20 | | | | 5 | | Yes |
| $C_8$ + 4EO +1BO at 15% | 30 | | 5 | | | | Yes |
| Acropol 35 + 5PO + 1.5EO at 15% | 20% | | 5 | | | 5 | Yes |
| 2-Ethylhexanol + 3.5EO + 1.5PO | | 20% | 5 | | | | Yes |
| 2-Ethylhexanol + 3.5EO + 1.5PO | 20 | | 5 | | | | Yes |

It should be realized by those skilled in the art that the invention is not limited to the exact configuration or methods illustrated above, but that various changes and modifications may be made without departing from the spirit and scope of the invention as described within the following claims.

What is claimed is:

1. A liquid fabric softening formulation comprising:

(A) an active fabric softening ingredient;

(B) from 12 to 60 percent by weight of an additive corresponding to the formula:

$$R_1—Q—(AO)_n—R_3$$

where $R_1$ is $C_{1-18}$alkyl; cycloalkyl or aryl

Q is O, C(O)O, or $NR_1$;

A is $CH_2CHR_2$;

$R_2$ and $R_3$ are independently at each occurrence H or $C_{1-4}$alkyl;

and n is2 to 13;

with the proviso that at least one $R_2$ is H and at least one $R_2$ is not H; and (C) water.

2. The formulation of claim 1 further comprising from 0.1 to 20 percent by weight of a solvent selected from aliphatic alcohols having 1 to 6 carbon atoms, aryl alkyl alcohols, aliphatic polyalcohols and their alkoxylates, aliphatic ethers, aliphatic esters, or alkylene carbonates or mixtures thereof.

3. The formulation of claim 2 wherein the solvent is propanol, butanol, isopropyl alcohol, ethanol, ethylene glycol, propylene glycol, dipropylene glycolpropyl ether (DPnP), dipropylene glycolbutyl ether (DPnB), or diethylene glycol butyl ether (DB).

4. The formulation of claim 2 wherein the solvent has a Clog P value of from 0.15 to 1.0.

5. The formulation of claim 4 wherein the solvent is 1,2-hexanediols, 2-ethyl-1,3-hexanediol, 2,2,4-trimethyl-1,3-pentanediol (and its ethoxylates), phenoxyethanol, or butyl carbitol or mixtures thereof.

6. The formulation of claim 1 further comprising from 0.1 to 20 percent by weight of at least one of a $C_4$–$C_{20}$ fatty alcohol or $C_4$–$C_{20}$ fatty acid, ethoxylated with up to 15 moles of EO.

7. The formulation of claim 1 wherein the active fabric softening composition is quaternary ammonium compounds, diamido ammonium compounds, or amido imidazolinium compounds or mixtures thereof.

8. The formulation of claim 7 wherein the active fabric softener composition includes a dialkyldimethyl ammonium compound.

9. The formulation of claim 7 wherein the active fabric softening composition is prepared from a mixture of fatty acids having predominantly 16 to 18 carbon atoms and an Iodine Value of from 20 to 140.

10. The formulation of claim 7 wherein the active fabric softening composition is prepared from a mixture of fatty acids having predominantly 12 to 14 carbon atoms and an Iodine Value of from 0 to 100.

11. The formulation of claim 7 wherein the active fabric softening composition is prepared from a mixture of fatty acids having 16 to 18 carbon atoms and Iodine Values of from 20 to 140 and fatty acids having 12–14 carbon atoms and Iodine Values of from 0 to 100.

12. The formulation of claim 7 wherein the active fabric softening composition includes an esterified quaternary ammonium compound.

13. The formulation of claim 12 wherein the ester quaternary ammonium compound includes oleic acid based diesterquats of triethanolamine, methyldiethanol amine or dimethylamino propanediol.

14. The formulation of claim 7 wherein the active fabric softener composition includes diethylenetriamine based compounds having the formula:

$$[R^4—(CO)—NR^6—(CH_2CH_2)—N(R^5)(R^8)—(CH_2CH_2)—NR^6—(CO)—R^4]^+, A^-$$

wherein $R^4$ together with (CO) is an oleoyl group; $R^5$ is H, $C_1$–$C_4$ alkyl or $(CH_2—CR^7HO)_t—H$, with t being from 1 to 7; $R^6$ is H, or $CH_2—CR^7HOH$; and $R^7$ is H or $C_1$–$C_4$ alkyl; $R^8$ is not present or $C_xH_{2x+1}$, where x is 0 to 4 and A– is an anion or not present when $R^8$ is not present.

15. The formulation of claim 7 wherein the active fabric softener composition is amido-esterquat or amido-esteramine.

16. The formulation of claim 7 wherein the active fabric softening compositions comprise from 4 to 65 percent by weight of the total formulation, and the additives comprise 5 to 35 percent by weight.

17. The formulation of claim 1 further comprising from 0.1 to 10 percent by weight of a fabric co-softener selected from the group consisting of fatty alcohols, fatty acids, fatty esters, fatty amines and amide/amides.

18. The formulation of claim 1 further comprising brighteners; dispersibility aids; stabilizers; soil-release agents; scum dispersant; perfumes; chelating agents; enzymes; colorants; preservatives; anti-shrinking agents; viscosity modifiers; bactericides and germicides; anti-corrosion agents; or pH adjusters.

19. The formulation of claim 1 wherein $R_3$ is H.

20. The formulation of claim 1 wherein the additive corresponds to the formula $$R_1—Q—[(AO)_m(CH_2CH_2O)_p(AO)_q]—R_3$$

where $R_1$, Q, A, and $R_3$ are as defined in claim 1;

$R_2$ is a $C_1$ to $C_4$ alkyl;

and where m is 0 to 5, p is 1 to 8, q is 0 to 5, m+p+q is equal to n, and m+q is not 0.

21. The formulation of claim 20, wherein m is 0, p is 1–8 and q is 1 to 5.

22. The formulation of claim 20 wherein m is 1 to 5, p is 1 to 3 and q is 0.

23. The formulation of claim 20 wherein m is 1 to 3, and p is 1 to 8 and q is 1 to 5.

24. The formulation of claim 20 wherein the units designated p and q are added by random addition.

25. The formulation of claim 20 wherein the units designated p are added by block addition.

26. The formulation of claim 20 wherein the units designated m are added by block addition.

27. The formulation of claim 1 wherein the additive corresponds to the formula:

$$R_1—Q—[(CH_2CH_2O)_p(AO)_s]—R_3$$

where $R_1$, Q, A, and $R_3$, are defined as in claim 1; $R_2$ is defined as in claim 1 including the proviso; p is 1 to 8; and s is 2–7, and wherein the units designated s are added by random addition.

28. A process to make fabric softening compositions comprising an active fabric softening ingredient which is either a quaternized amine with amide groups, a quaternized amine with ester groups, a quaternized amido amine, or a quaternized imidazoline wherein the active fabric softening ingredient is prepared by reacting a fatty acid or triglyceride with an amine group having a reactive hydrogen and then quaternizing the reaction product in the presence of a solvent; characterized in that at least a portion of the solvent is replaced with an additive corresponding to the formula:

$$R_1—Q—(AO)_n—R_3$$

Where $R_1$ is $C_{1-18}$ alkyl;

Q is O, C(O)O, or $NR_1$;

A is $CH_2CHR_2$;

$R_2$ and $R_3$ are independently at each occurrence H or $C_{1-4}$ alkyl;

and n is 2 to 13;

with the proviso that at least one $R_2$ is H and at least one $R_2$ is not H.

29. A clear liquid fabric softening formulation comprising:

(a) from 5 to 70 percent by weight of an active fabric softening ingredient;

(b) from 5 to 35 percent by weight of an additive corresponding to the formula:

$$R_1—Q—(AO)_n—H$$

where $R_1$ is $C_{1-18}$ alkyl; cycloalkyl or aryl; Q is O, C(O)O, or $NR_1$; A is $CH_2CHR_2$; $R_2$ is independently at each occurrence H or $C_{1-4}$ alkyl with the proviso that at least one $R_2$ is H and at least one $R_2$ is not H; n is 2 to 13; and (c) more than 10 percent by weight of water.

* * * * *